US011446702B2

(12) United States Patent
Roderick

(10) Patent No.: US 11,446,702 B2
(45) Date of Patent: Sep. 20, 2022

(54) SYSTEM AND METHOD FOR SELECTIVELY FILTERING ABRASIVE PARTICLES FOR A WATERJET CUTTER

(71) Applicant: Daniel E. Roderick, Central Point, OR (US)

(72) Inventor: Daniel E. Roderick, Central Point, OR (US)

( * ) Notice: Subject to any disclaimer, the term of this patent is extended or adjusted under 35 U.S.C. 154(b) by 165 days.

(21) Appl. No.: 17/093,524

(22) Filed: Nov. 9, 2020

(65) Prior Publication Data

US 2021/0138609 A1 May 13, 2021

Related U.S. Application Data

(60) Provisional application No. 62/932,208, filed on Nov. 7, 2019.

(51) Int. Cl.
*B07B 1/28* (2006.01)
*B07B 1/06* (2006.01)
(Continued)

(52) U.S. Cl.
CPC ..... *B07B 1/28* (2013.01); *B07B 1/06* (2013.01); *B07B 1/42* (2013.01); *B07B 1/4663* (2013.01);
(Continued)

(58) Field of Classification Search
CPC .... B07B 1/28; B07B 1/06; B07B 1/42; B07B 1/4663; B07B 1/4645; B07B 1/4609; B07B 13/003; B07B 13/04; B24C 7/003; B24C 9/00; B24C 9/006; B24C 9/003; B24C 1/04; B03B 5/02; Y02P 70/10
(Continued)

(56) References Cited

U.S. PATENT DOCUMENTS 5,138,351 A 8/1992 Wiegand et al.
5,663,711 A 9/1997 Sanders et al.
(Continued)

FOREIGN PATENT DOCUMENTS

CN 106622949 A * 5/2017
CN 104399664 B * 7/2017 ..... B07B 1/28
DE 102015114076 B3 * 5/2016 ..... B07B 1/28

*Primary Examiner* — Gene O Crawford
*Assistant Examiner* — Muhammad Awais
(74) *Attorney, Agent, or Firm* — Vincent G. LoTempio, Esq.

(57) ABSTRACT

A system and method for selectively filtering abrasive particles for a cutting machine serves to filter variously shaped and dimensioned abrasive particles into a hopper through use of multiple, interchangeable screens. Each screen forms multiple openings defined by a shape and dimension, and each screen has a unique shape and dimension. A pneumatic variable speed motor vibrates the screens at variable speeds, depending on intensity of air flow through an air inlet. The sieve subassembly has a main base and containment ring. A two-piece split clamp ring sandwich the perimeter region of screens. From the hopper, a flow of high-pressure air carries the filtered abrasive particles to a waterjet cutting machine. The filtered abrasive particles are
(Continued)

mixed with high pressure water to cut a workpiece. The shape and dimension of the abrasive particle is determinative of the type of workpiece to be cut.

20 Claims, 7 Drawing Sheets

(51) Int. Cl.

| | |
|---|---|
| ***B07B 1/42*** | (2006.01) |
| ***B07B 1/46*** | (2006.01) |
| ***B07B 13/00*** | (2006.01) |
| ***B07B 13/04*** | (2006.01) |
| ***B24C 9/00*** | (2006.01) |
| ***B24C 7/00*** | (2006.01) |
| *B03B 5/02* | (2006.01) |

(52) U.S. Cl.
CPC ..... *B07B 13/003* (2013.01); *B07B 13/04* (2013.01); *B24C 7/003* (2013.01); *B24C 9/00* (2013.01); *B03B 5/02* (2013.01)

(58) Field of Classification Search
USPC ..... 209/233
See application file for complete search history.

(56) References Cited

U.S. PATENT DOCUMENTS

| | | | | |
|---|---|---|---|---|
| 6,003,679 | A * | 12/1999 | Maroscher | B07B 1/42 209/326 |
| 6,805,618 | B1 * | 10/2004 | Ward | B24C 9/006 451/87 |
| 7,004,595 | B1 | 2/2006 | Stoddard | |
| 7,121,707 | B2 | 10/2006 | Currie et al. | |
| 7,490,958 | B1 | 2/2009 | Stoddard | |
| 8,105,106 | B1 | 1/2012 | Stoddard | |
| 8,303,333 | B2 | 11/2012 | Lee | |
| 9,010,540 | B2 * | 4/2015 | Smith | B07B 1/06 209/326 |
| 9,573,248 | B2 * | 2/2017 | Bernard | B24C 9/006 |
| 2007/0109140 | A1 | 5/2007 | Nicks et al. | |
| 2008/0211321 | A1 | 9/2008 | Liao | |
| 2008/0233780 | A1 | 9/2008 | Waters et al. | |
| 2014/0170903 | A1 | 6/2014 | Tuchrelo et al. | |
| 2014/0213150 | A1 * | 7/2014 | Schubert | B24C 1/045 451/99 |
| 2018/0080734 | A1 * | 3/2018 | Miller | B24C 7/0015 |
| 2019/0337018 | A1 * | 11/2019 | Tatsumoto | B07B 1/36 |

* cited by examiner

SYSTEM AND METHOD FOR SELECTIVELY FILTERING ABRASIVE PARTICLES FOR A WATERJET CUTTER

CROSS REFERENCE OF RELATED APPLICATIONS

This application claims the benefits of U.S. provisional application No. 62/932,208, filed Nov. 7, 2019 and entitled PORTABLE WORKPIECE CUTTING FILTER DEVICE AND METHOD OF OPERATION, which provisional application is incorporated by reference herein in its entirety.

FIELD OF THE INVENTION

The present invention relates generally to a system and method for selectively filtering abrasive particles for a waterjet cutting machine. More so, the present invention relates to a filtering system that separates variously shaped and dimensioned abrasive particles and foreign debris into a hopper through use of multiple, interchangeable sieves; whereby a flow of high-pressure air carries the filtered abrasive particles to a waterjet cutting machine; whereby the filtered abrasive particles are mixed with high pressure water to cut a workpiece; whereby the shape and dimension of the abrasive particle is determinative of the type of workpiece to be cut.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Typically, abrasive articles are used with a waterjet cutter for cutting workpieces, or for abrading, grinding, and polishing applications. Waterjet cutters eject an abrasive blast stream onto a surface for cutting the workpiece, or for deburring, abrading, smoothing, or removing surface material. Often, abrasive particulate such as sand, sodium bicarbonate, walnut shells, plastic or other matter are ejected under pressure to impact the surface. Wet blasting systems eject the abrasive particulate in a stream of water under pressure. The water stream keeps the dust down, and thus, keeps the ambient air cleaner.

In many instances, waterjet cutters are generally provided with a cutting head capable of delivering, through a specific nozzle, a very thin jet of water, with a diameter between 0.3 mm and 2.0 mm, at very high pressure, up to 6,000 bar and more. To cut a wide range of materials, such as metals, stone, marble, glass, plastics, etc., abrasive particles are dispersed in the water to increase the erosive capacity of the water jet.

Other proposals have involved waterjet cutting systems. The problem with these cutting devices is that they do not selectively filter the abrasive particles to accommodate different types of workpieces that require different shapes and dimensions of abrasive particles. Even though the above cited waterjet cutting systems meet some of the needs of the market, a system and method for selectively filtering abrasive particles for a waterjet cutting machine that separates variously shaped and dimensioned abrasive particles from foreign debris prior to entering a hopper through use of multiple, interchangeable sieves; whereby a flow of high-pressure air carries the filtered abrasive particles to a waterjet cutting machine; whereby the filtered abrasive particles are mixed with high pressure water to cut a workpiece; whereby the shape and dimension of the abrasive particle is determinative of the type of workpiece to be cut, is still desired.

SUMMARY

Illustrative embodiments of the disclosure are generally directed to a system and method for selectively filtering abrasive particles for a cutting machine. The system serves to filter variously shaped and dimensioned abrasive particles into a hopper through use of multiple, interchangeable screens. The abrasive particles are filtered into a hopper while undesirable foreign debris is kept from entering the hopper, upon which the system sits atop. From the hopper, a flow of high-pressure air carries the filtered abrasive particles to a waterjet cutting machine. The filtered abrasive particles are mixed with high pressure water to cut a workpiece. The shape and dimension of the abrasive particle is determinative of the type of workpiece to be cut.

One embodiment of the system for selectively filtering abrasive particles for a cutting machine, comprises a sieve subassembly comprising a containment ring and a main base. The sieve assembly rests freely on top of the hopper 104 via the bottom surface of the main base 203.

Each screen forms multiple openings defined by a shape and dimension. Each screen is defined by an opening having a unique shape and dimension.

Sieve subassembly comprises a containment ring and a main base that are welded together. Containment ring and main base in addition are arranged to sandwich the perimeter region of screens to securely retain screens into a concentric position in sieve subassembly.

System for selectively filtering abrasive particles may also utilize a pneumatic variable speed motor that is operably connected to the main base of the sieve subassembly. The pneumatic variable speed motor is operable to vibrate the screens at variable speeds. In one embodiment, an air inlet is in fluid communication with the pneumatic variable speed motor. The air inlet is configured to enable discharge of air flow into the pneumatic variable speed motor. In another embodiment, an air valve operatively joins with the air inlet. The air valve is configured to regulate the air flow through the air inlet.

In one possible, though not required, embodiment, sieve subassembly feeds the filtered abrasive particles into a hopper. The hopper may be defined by multiple sidewalls forming an outlet passageway. The sidewalls define a cavity, and extending up to a peripheral edge that forms a mouth. The peripheral edge of the sidewalls is disposed to detachably attach to sieve subassembly 102, such that the screens interchangeably rest atop the hopper.

In one possible, though not required, embodiment, a cutting machine, such a high-pressure waterjet cutter receives the filtered abrasive particles from hopper through high pressure air flow in a feed tube. Cutting machine comprises a container where the abrasive particles are mixed with high pressure water for cutting a workpiece as the abrasive particle/water mixture pass through a cutting head.

In another aspect, at least one fastener fastens containment ring and main base to two piece split clamp ring segment.

In another aspect, the cavity of the hopper includes at least one of the following dimensions: 100 pounds, 600 pounds, and 2,200 pounds.

In another aspect, the hopper comprises a bulk delivery hopper.

In another aspect, the system further comprises a pneumatic variable speed motor operably connected to the sieve subassembly.

In another aspect, the variable speed motor is operable to vibrate the screens at variable speeds.

In another aspect, the motor is pneumatically operated.

In another aspect, the ring clamp comprises a steel ring.

In another aspect, the screens are operable to filter foreign debris from multiple abrasive particles.

In another aspect, the abrasive particles comprise multiple dimensions and shapes.

In another aspect, the abrasive particles selectively fall through the openings in the screens, and into the connected hopper. However, the system does not connect to the hopper just for clarification. Rather, the system sits on top of the hopper, and is free to move. This freedom of movement enables vibratory motion to sift particles into the hopper.

In another aspect, the screens are operable to filter at least one foreign debris from multiple abrasive particles, the screens further being operable to segregate different sizes and dimensions of the abrasive particles.

In another aspect, the filtered abrasive particles selectively fall through the openings in the screens, and into the connected hopper.

In another aspect, the cutting machine comprises a waterjet cutter that is in fluid communication with the hopper.

In another aspect, the cutting head comprises a mixing tube/abrasive nozzle.

In another aspect, the system also includes a pressure generator operable to forcibly urge the filtered abrasive particles from the cavity of the hopper to the waterjet cutting machine.

One objective of the present invention is to filter foreign debris from abrasive particles for a waterjet cutter to selectively cut different types of workpieces.

Yet another objective is to provide multiple interchangeable screens that can be used to adjust the size of abrasive particles introduced into a main bulk delivery hopper.

Another objective is to filter foreign debris from the abrasive particles, so as to mitigate down time, loss of parts, and material spoilage in the nozzles of the waterjet cutting machine.

Another objective is to enable easy fastening and release of the screens to the sieve subassembly.

Another objective is to filter foreign objects and debris from variously shaped and dimensioned abrasive particles, before the abrasive particles are introduced into the hopper.

Another objective is to eliminate nozzle clogs in the waterjet cutting machine, due to contaminants in prepackaged abrasive particles used in the water jet cutting process.

Yet another objective is to remove contaminants and the risk of clogged nozzles in a waterjet cutting machine, so as to reduce downtime and the scrapping of material/parts that are being cut.

An exemplary objective is to provide an inexpensive to manufacture system for selectively filtering abrasive particles for a cutting machine.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

DETAILED DESCRIPTION OF THE INVENTION

Figure 1:
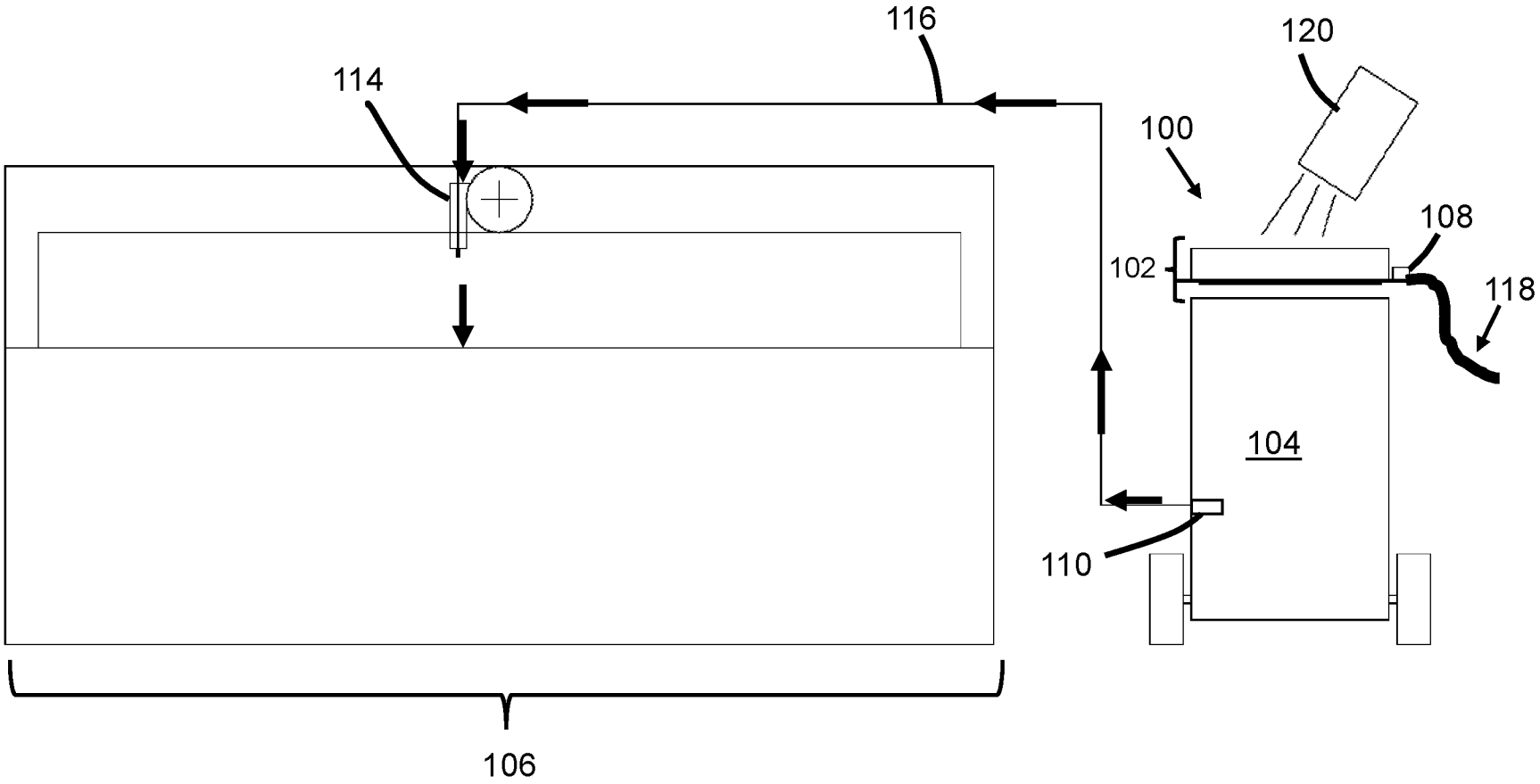
FIG. 1 illustrates a perspective view of an exemplary system and method for selectively filtering abrasive particles for a waterjet cutting machine, showing the filter device resting atop a main bulk delivery hopper, and an abrasive flow line carrying filtered abrasive particles to a container for discharge into a waterjet cutting machine, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

PARTS LIST system 100
sieve subassembly 102
hopper 104
cutting machine 106
pneumatic variable speed motor 108
pressure generator 110
cutting head 114
feed tube 116
air hose 118
container of pre-packaged abrasive particles 120
interchangeable screens 200*a-n*
openings 202*a-n*
main base 203
containment ring 204
two-piece split clamp ring 205*a*, 205*b*
air inlet 206
at least one fastener 208*a-n*
air valve 210
perimeter region 400
filtering abrasive particles 700*a-c*
foreign debris 702*a-c*

A system 100 and method for selectively filtering abrasive particles for a waterjet cutting machine is referenced in FIGS. 1-7. As referenced in FIG. 1, System 100 for selectively filtering abrasive particles 700*a-c*, hereafter "system 100" is configured for selectively filtering abrasive particles 700*a-c* for a cutting machine 106. System 100 serves to filter foreign debris from variously shaped and dimensioned abrasive particles 700*a-c* through use of multiple, interchangeable screens 200*a-n*. System 100 is unique in that the interchangeable screens 200*a-n* are easily replaced/interchanged to accommodate various sizes of abrasive particles 700*a-c* used in the waterjet cutting process. A sieve subassembly 102 concentrically holds the screens in a secure position.

System 100 may also utilize a pneumatic variable speed motor 108 that is operably connected to the main base 203 of the sieve subassembly. Pneumatic variable speed motor 108 is operable to vibrate the screens at variable speeds. The interchangeability of the screens 200*a-n* serves to remove foreign debris from the abrasive particles 700*a-c*, before abrasive particles 700*a-c* are introduced into the nozzles of cutting machine 106. By quickly interchanging the filtering capacity of the sieve subassembly 102, the cutting efficacy of cutting machine 106 is easily adjusted to accommodate different workpiece cutting requirements. Furthermore, filtering the foreign debris 702*a-c* from abrasive particles 700*a-c* serves to mitigate down time, loss of parts, material spoilage and clogs in the nozzles of cutting machine 106.

Figure 2:
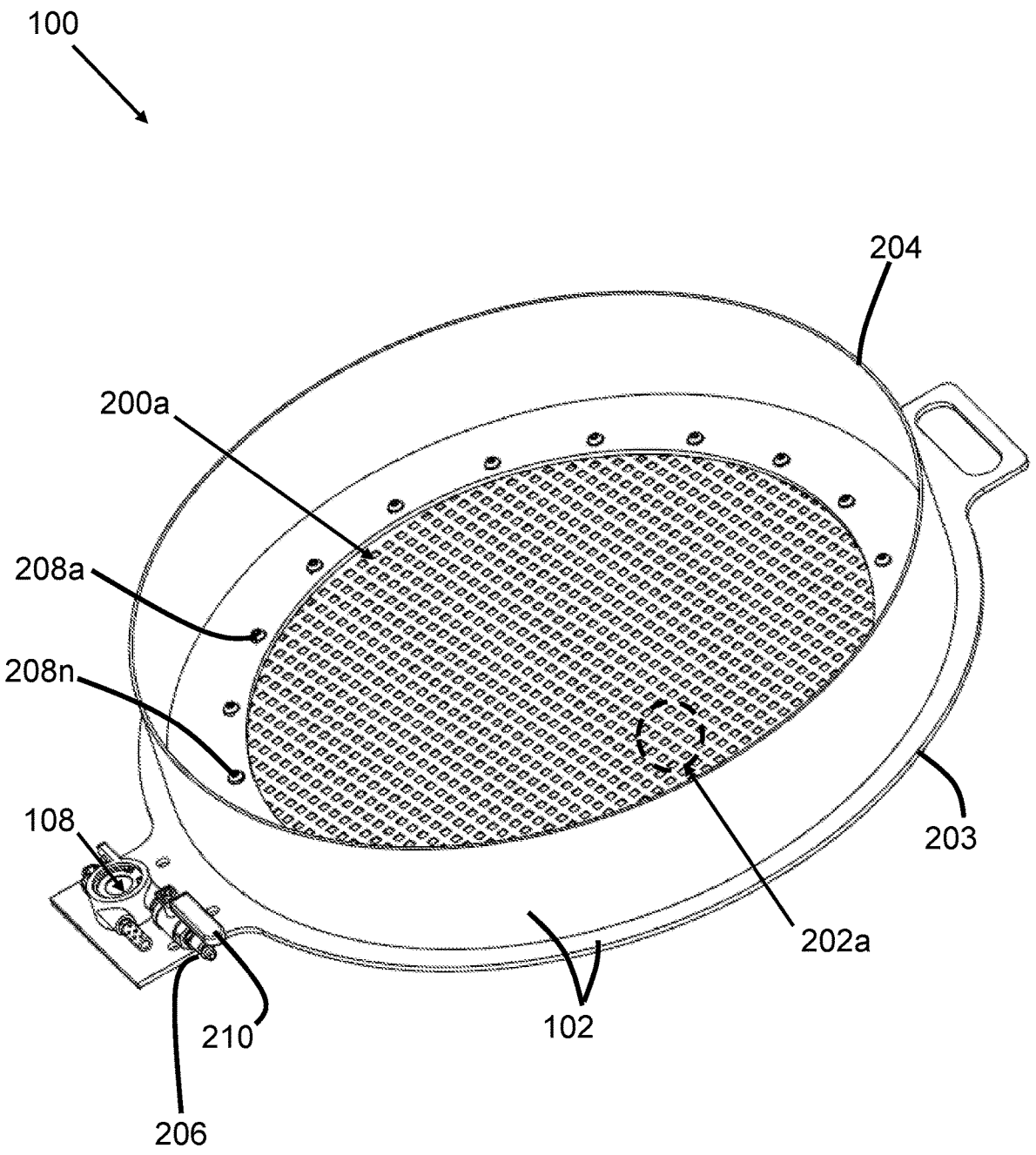
FIG. 2 illustrates a perspective view of an exemplary sieve subassembly, in accordance with an embodiment of the present invention.

Turning now to FIG. 2, the foreign debris 702*a-c* is filtered out by the screens 200*a-n*. In one non-limiting embodiment, the sieve subassembly sits freely on top of the hopper 104 via the bottom surface of the main base 203. The screens 200*a-n*, which are sandwiched between the main base 203 and the two-piece split clamp ring 205*a*, 205*b*, serve to filter the foreign debris from the abrasive particles 700*a-c*. The abrasive particles 700*a-c* fall directly into hopper 104 and withhold undesirable foreign debris 702*a-c* from entering into hopper 104. From the hopper 104, a flow of high-pressure air carries the filtered abrasive particles 700*a-c* to a cutting machine 106. The filtered abrasive particles 700*a-c* are mixed with high pressure water to cut a workpiece. The shape and dimension of the abrasive particle is determinative of the type of workpiece to be cut.

Figure 3:
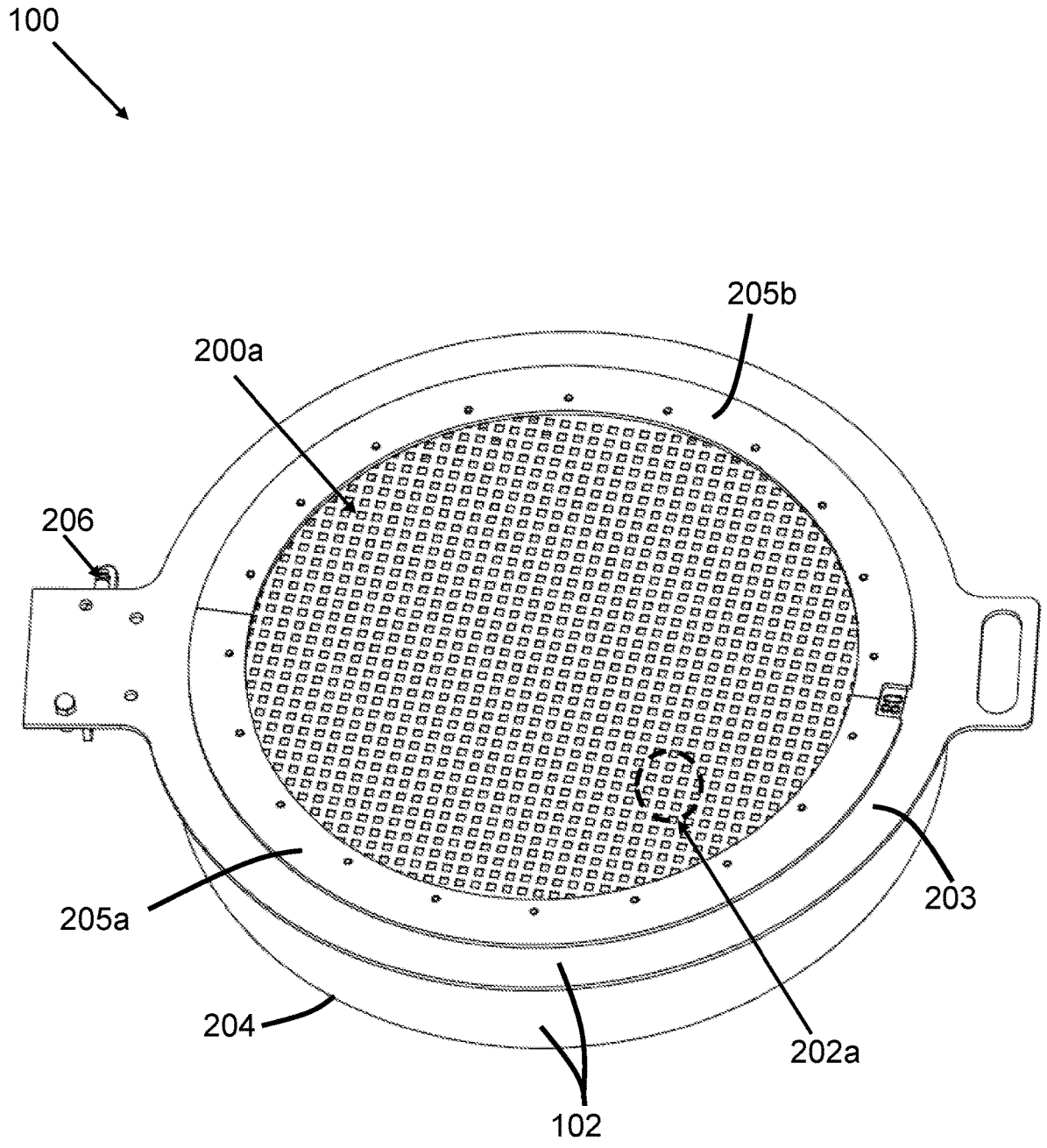
FIG. 3 illustrates a bottom view of the sieve subassembly shown in FIG. 1, in accordance with an embodiment of the present invention.

As referenced in FIG. 3, system 100 comprises a sieve subassembly 102 comprising a main base 203 and containment ring 204 that are welded together. Main base 203 and two-piece split clamp ring 205*a*, 205*b* are arranged to sandwich the perimeter region 400 of screens 200*a-n* to securely retain screens into a concentric position in sieve subassembly 102.

System 100 is unique in providing multiple interchangeable screens 200*a-n*. Each screen 200*a*, 200*n* is defined by a perimeter region 400 that may include fastening holes through which at least one fastener 208*a*, 208*n*, such as screws pass. Further, each screen 200*a-n* forms multiple openings 202*a-n* that are defined by a shape and/or dimension. Each screen is defined a unique shape, and/or a unique dimension. The screens 200*a-n* are operable to filter out at least one foreign debris 702*a-c* from multiple abrasive particles 700*a-c* having different shapes and dimensions.

It is known in the art that abrasive particles 700*a-c* comprise multiple dimensions and shapes for different cutting/abrasive/polishing functions. The filtered abrasive particles 700*a-c* selectively fall through the openings 202*a-n* in the screens 200*a-n*, and in some embodiments, into the connected hopper 104. The screens 200*a-n* work to segregate different sizes and dimensions of the abrasive particles 700*a-c*.

Figure 4:
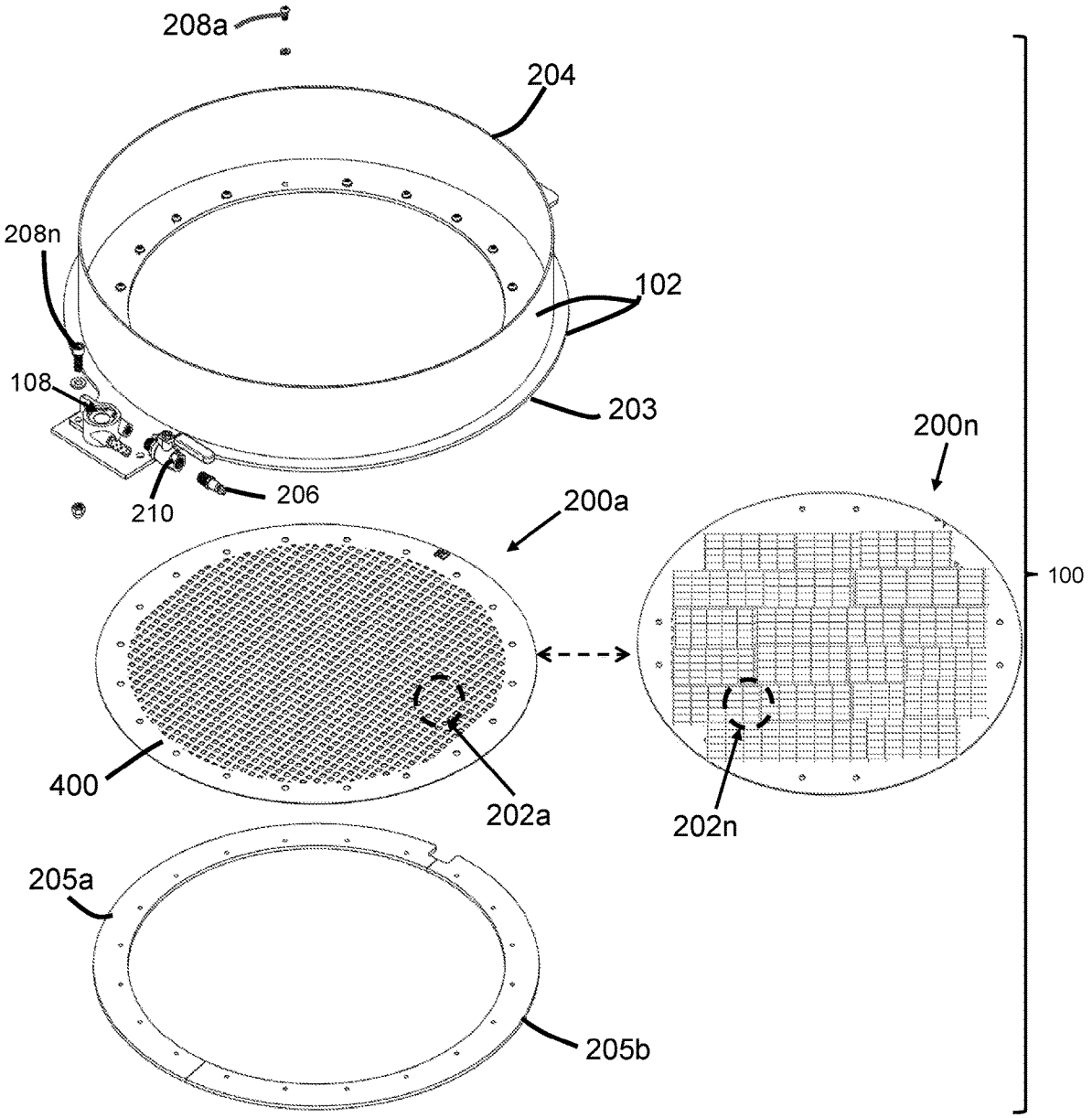
FIG. 4 illustrates a blow-up view of the sieve subassembly, showing two screens interchanging, in accordance with an embodiment of the present invention.

As discussed above, each screen 200*a*, 200*n* is defined by uniquely sized opening 202*a-n* for charactering the size distribution of abrasive particles 700*a-c*. For example, FIG. 4 shows a first screen having annular-shaped openings 202*a*, and a second screen positioned for interchanging and having rectangular-shaped openings 202*n*. Thus, the openings 202*a-n* for each screen may have different diameters, shapes, and dimensions in general. Openings 202*a-n* are shaped and configured to both, filter foreign objects 702*a-c* from the abrasive particles 700*a-c*, and filter the differently shaped and dimensioned abrasive particles 700*a-c* for selective use in the cutting machine.

It is also significant to note that screens 200*a*, 200*n* are easily interchanged, so as to accommodate the various sizes of abrasive particles 700*a-c* required for cutting the different types/hardness/shapes of the workpiece. Screens 200*a-n* may have an annular shape and be fabricated from a metal material. Though in other embodiments, screens 200*a-n* may have rectangular, square, or irregular shapes. Interchangeable screens 200*a-n* may also be marked (numbers, colors, etc.) for quick reference to verify that an appropriate screen is being used to sift the abrasive particles 700*a-c* for a corresponding workpiece. It is significant to note that the abrasive particles 700*a-c* sizes change; the screens 200*a-n* are used to vary the size and shape of abrasive particles 700*a-c* being filtered. This provides greater flexibility during waterjet cutting operations.

Figure 7:
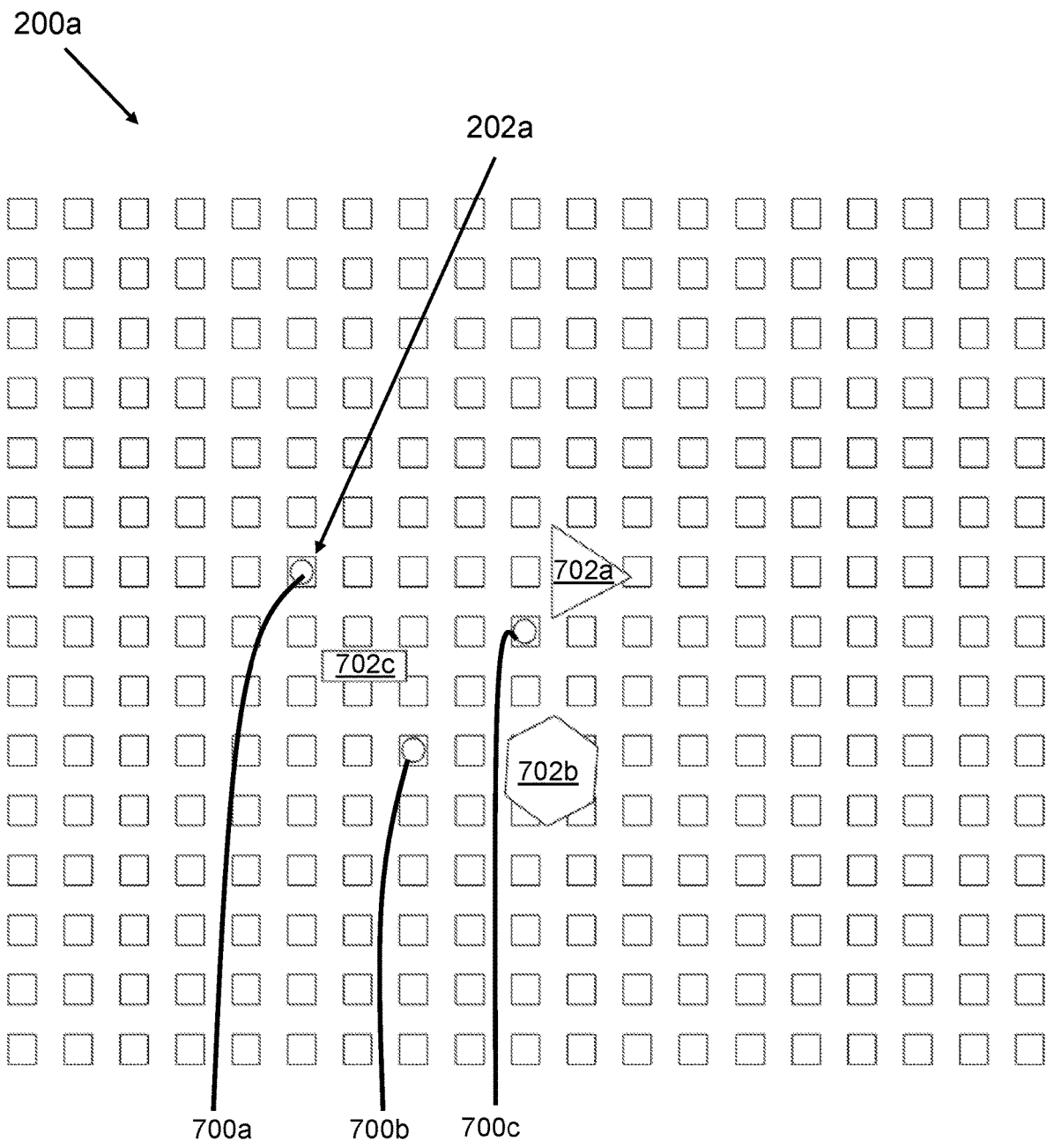
FIG. 7 illustrates a close up view of the abrasive particles and foreign objects on an exemplary screen, in accordance with an embodiment of the present invention Like reference numerals refer to like parts throughout the various views of the drawings

Looking ahead to FIG. 7, abrasive particles 700*a*, 700*b*, 700*c* includes various sized and shapes garnets. In one possible embodiment, abrasive particles 700*a-c* are a garnet, serving as the cutting means for the waterjet cutting process. However, other abrasive particles 700*a-c*, such as diamond dust, may also be used. In some embodiments, abrasive particles 700*a-c* comprise crushed garnet in various sizes. However, in other embodiments, abrasive particles 700*a-c* may include abrasives that are not garnet. As FIG. 1 shows, a container of pre-packaged abrasive particles 120, such as a paper bag, may be used to load abrasive particles 700*a-c* into system 100.

Those skilled in the art will recognize that the abrasive particles 700*a-c* are required to be dry, like sand, in order to flow through openings 202*a-n* in screens 200*a-n*. Abrasive particles 700*a-c* are sifted prior to entering a main bulk delivery hopper. Then, abrasive particles 700*a-c* mix with a high-pressure fluid, such as water to pass through nozzles in cutting machine 106 for cutting through a workpiece.

However, those skilled in the art will recognize that foreign debris 702*a-c* are not completely removed when the abrasive particles 700*a-c* are packaged by the manufacturer. In operation, the container of pre-packaged abrasive particles 120 is loaded into the sieve subassembly 102 by the machine operator. When the sieve subassembly 102 is not used, the bags which are 55 lbs each are set on top of hopper 104 then opened up with a box cutter, and then ripped open allowing any foreign debris, including the paper, from tearing the bags open into the hopper 104 (See FIG. 6). Those skilled in the art will recognize that any foreign debris 702*a-c* that is not screened prior to entering the hopper 104 can create significant cutting problems.

In one embodiment, sieve subassembly 102 serves to concentrically hold the screens 200*a-n* parallel to a horizontal plane. Main base 203, containment ring 204 and two-piece split clamp ring 205*a*, 205*b* may have an annular shape that matches the shape of screens 200*a-n*. In one non-limiting embodiment, two-piece split clamp ring 205*a*, 205*b* comprises a steel ring having an annular shape, and operable to be selectively tightened and loosened around the perimeter region 400 of screen 200*a-n*.

In other embodiments, two-piece split clamp ring 205*a*, 205*b* is a bifurcated ring that is joined by screws, bolts, and the like. In this manner, multiple interchangeable screens 200*a-n* can be used to adjust the size of abrasive particles 700*a*, 700*b*, 700*c*. Two-piece split clamp ring 205*a*, 205*b* may be annular and flat.

Figure 5:
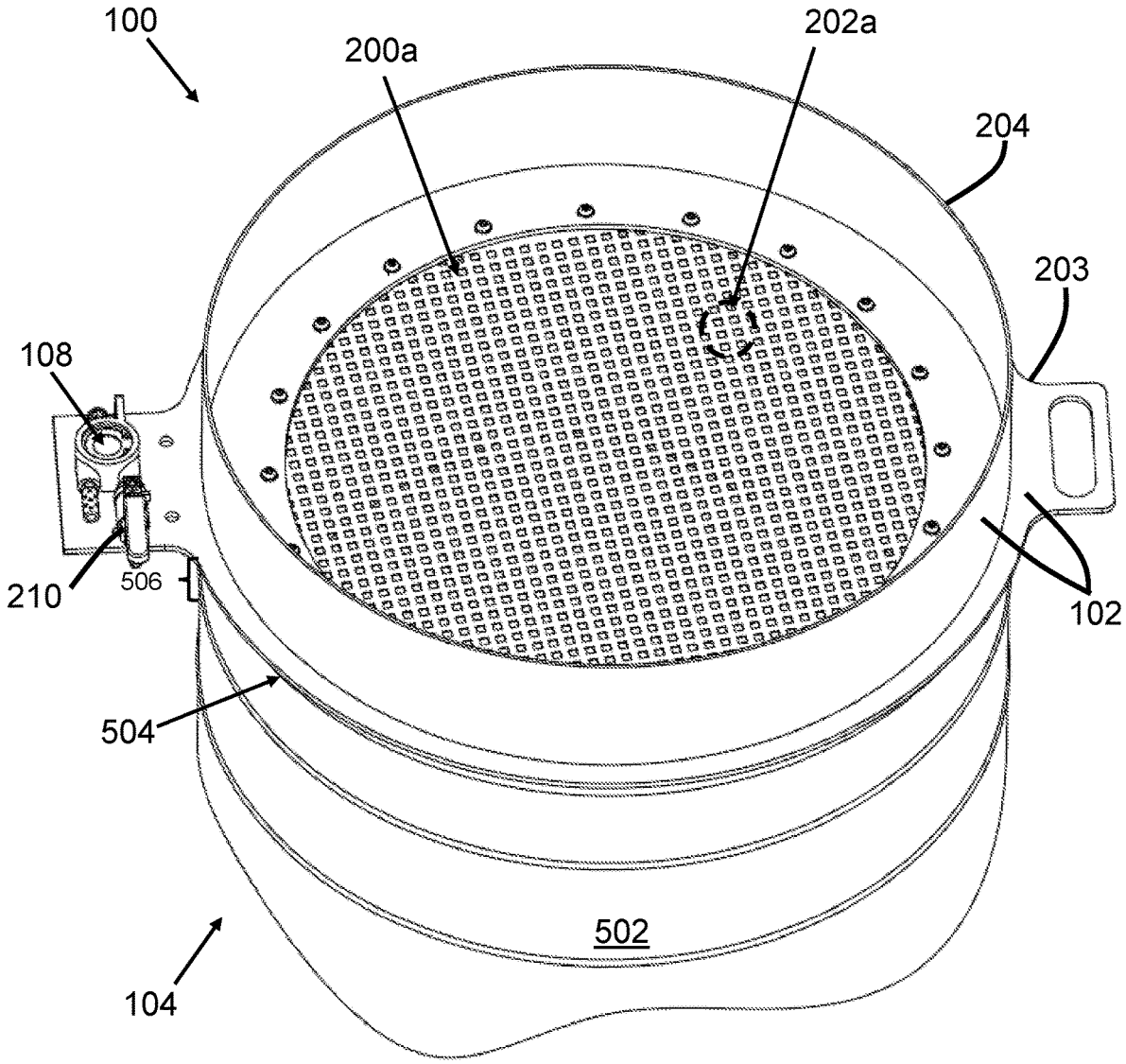
FIG. 5 illustrates a perspective view of the sieve subassembly freely sitting on top of the hopper 104 via the bottom surface of the main base 203, in accordance with an embodiment of the present invention.
Figure 6:
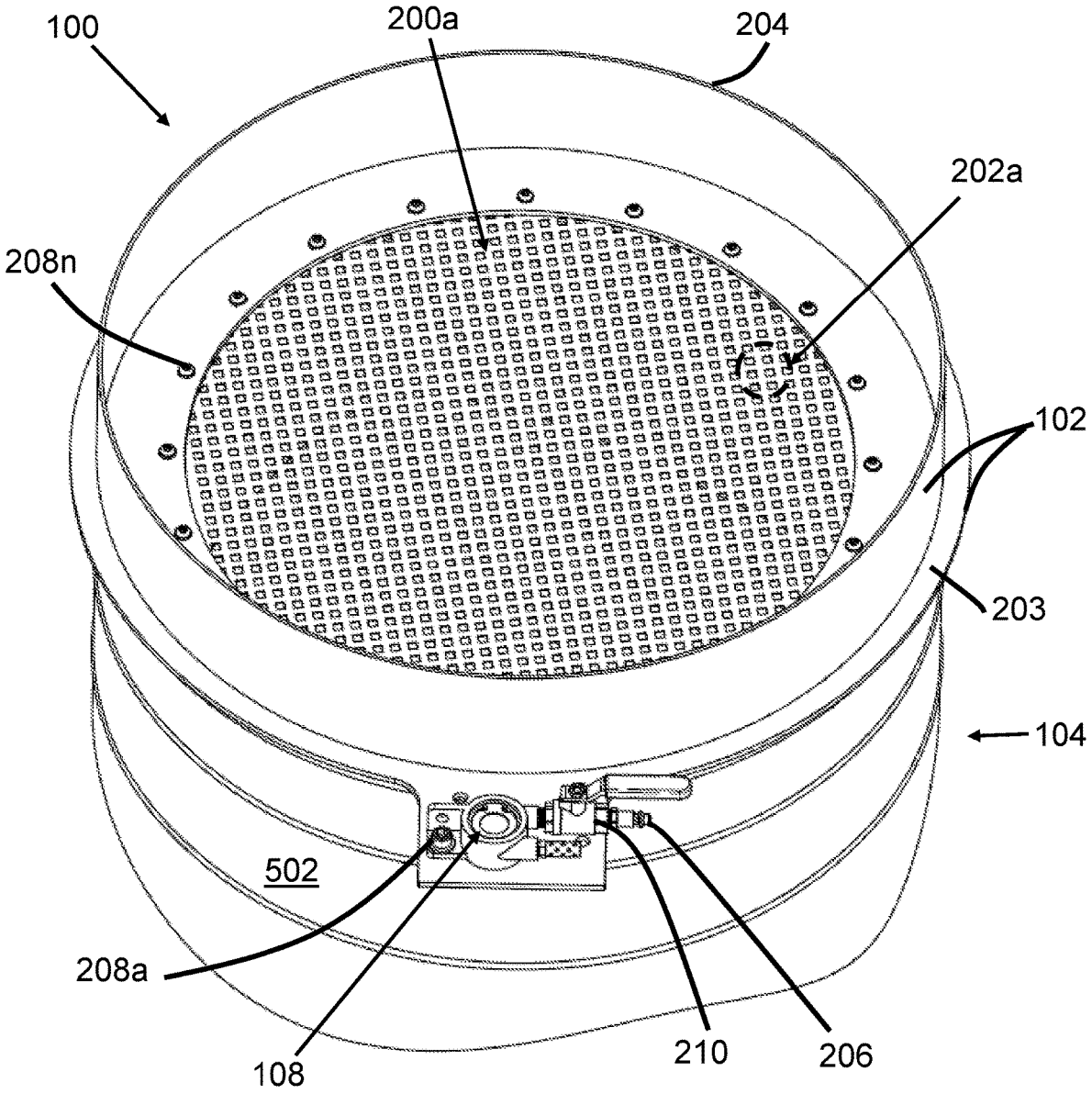
FIG. 6 illustrates a perspective view of the sieve subassembly freely sitting on the hopper, showing the fastener oriented forward, in accordance with an embodiment of the present invention.

In another embodiment, at least one fastener 208*a-n* releasably fastens the screens 200*a-n* in the sieve subassembly 102. Fastener 208*a-n* is designed to pass through fastening holes in main base 203 and two-piece split clamp ring 205*a*, 205*b*, such that the multiple screens 200*a-n* interchangeably fasten to the sieve subassembly 102. As FIG. 5 illustrates, screens 200*a-n* are bolted and unbolted in place to the main base 203 through multiple retaining screws. In another embodiment, interchangeable screens 200*a*, 200*n* are removed from the sieve subassembly 102 by removing twenty screws to allow swap out of the screens 200*a*, 200*n*.

In one embodiment, fastener comprises multiple screws that pass through fastening holes. However, in other embodiments, any bolt, weld, adhesive, magnet, cable, snap-fit mechanism, or other fastening means may be used. For example, FIG. 4 illustrates the sieve subassembly 102, showing two screens 200*a*, 200*n* interchanging. Fastener 208*a-n* enables easy fastening and release of the screens 200*a-n* into the sieve subassembly 102.

System 100 may also utilize a pneumatic variable speed motor 108 that is operably connected to sieve subassembly 102. Pneumatic variable speed motor 108 is operable to vibrate the screens 200*a-n* at variable speeds for enhanced filtering of abrasive particles 700*a-c*. In one embodiment, an air inlet 206 is in fluid communication with pneumatic variable speed motor 108. Air inlet 206 is configured to enable discharge of air flow into pneumatic variable speed motor 108. A high-pressure air source may attach to the air inlet 206 through an air hose 118 (See FIG. 1). In another embodiment, an air valve 210 operatively joins with air inlet 206. A connecter tube may be used to threadably join air hose 118 to air valve 210. Air valve 210 is configured to regulate the air flow through the pneumatic variable speed motor 108. In one non-limiting embodiment, air valve 210 is a ball valve with a mechanical handle extending therefrom.

Though the system does not require to be attached to another structure, in one possible embodiment, a hopper 104 is utilized for catching the filtered abrasive particles 700*a-c* falling from the interchangeable screens 200*a-n*. Hopper 104 serves as the storage device for the abrasive particles 700*a-c*. In one non-limiting embodiment, hopper 104 comprises a bulk delivery hopper 104. Hopper 104 is defined by multiple sidewalls forming an outlet passageway. The sidewalls 502 define a cavity, and extending up to a peripheral edge 504 that forms a mouth 506. The peripheral edge of the sidewalls 502 is disposed to detachably attach to clamp ring 205*a-b* and main base 203. Two-piece split clamp ring 205*a-b* sit inside the opening of the hopper 104 keeping it from sliding off but allowing it to move freely while sifting action is taking place.

In some embodiments, a pressure generator 110 is configured to forcibly urge the filtered abrasive particles 700*a-c* from the cavity of the hopper 104 to a container in cutting machine. Pressure generator 110 may include a pump, a high-pressure flowage of fluid, or a vacuum. In some embodiments, the cavity of hopper 104 may have the following capacity: 100 pounds, 600 pounds, and 2,200 pounds. Hopper 104 is configured in multiple sizes and shapes for carrying different quantities and types of abrasive material. In one non-limiting embodiment, hopper 104 can be one of: a 100-pound hopper; a 600-pound hopper; and a 2200-pound hopper. In one exemplary use, sieve subassembly 102 freely sits on top of the 600-pound hopper.

In another embodiment, hopper 104 has a lid that can be removed to enable placing the sieve subassembly 102 thereon. Based on the cutting needs of the cutting machine 106, any one of the variously shaped and dimensioned screens 200*a-n* can be interchanged from the mouth of the hopper 104. In one non-limiting embodiment, hopper 104 comprises a pair of wheels or rollers that facilitate mobility of hopper 104, and the attached sieve subassembly 102.

For example, FIG. 1 illustrates a perspective view of the sieve subassembly 102 operatively joined with cutting machine 106, showing a pneumatic variable speed motor 108. Those skilled in the art will recognize that if foreign matter enters hopper 104 it is problematic, as it creates nozzle clogging and cutting issues during waterjet cutting operations. Sieve subassembly 102 helps prevent lost time in clearing nozzle clogs, and the requirement to clean out the hopper 104. Thus, sieve subassembly 102 sets on top of hopper 104 and the abrasive particles 700*a-c* are filtered through prior to entering cavity of hopper 104.

In some embodiments, the system 100 may also provide a pneumatic variable speed motor 108 that is operably connected to the main base 203 of the sieve subassembly 102. Pneumatic variable speed motor 108 is operable to vibrate screens 200*a-n* at variable speeds. The resultant vibratory motion sifts the abrasive particles 700*a-c* into hopper 104 while removing foreign objects therefrom. This serves to mitigate the risk of waterjet cutting machine 106 down time and loss of parts and material spoilage due to nozzle clogs.

In one non-limiting embodiment, the motor is pneumatically operated. Pneumatic variable speed motor 108 creates vibration throughout the product which sifts the abrasive particles 700*a-c* into hopper 104. Variable speed motor 108 is operable to vibrate the sieve subassembly 102 at variable speeds. In one non-limiting embodiment, variable speed pneumatic motor is pneumatically operated.

However, in other embodiments, variable speed motor 108 may be electrical, or powered by other means known in the art. Thus, by vibrating screens 200*a-n* in this manner, the abrasive particles 700*a-c* selectively fall through interchangeable screens 200*a-n*, and into the connected hopper 104. In one possible embodiment, variable speed motor 108 is adapted to be used specifically for containment and delivery of abrasive cutting material to hopper 104 that holds the abrasive particles 700*a-c* for the waterjet cutting application.

In some embodiments, a pneumatic on/off valve is operable with variable speed motor 108 to shut off power and regulate speed. Pneumatic on/off valve serves to regulate discharge of abrasive particles 700*a-c* into hopper 104, before feeding into a container through a feed tube 116 that extends between outlet passageway in hopper 104 to inlet passageway of cutting machine 106. Feed tube 116 carries abrasive particles 700*a-c* to container that stores the abrasive particles 700*a-c* until discharged into cutting head 114 of cutting machine 106. A high pressure air flow forcibly urges abrasive particles 700*a-c* through feed tube 116. Cutting head is continuously fed with abrasive particles 700*a-c* received from hopper 104 while mixing with high pressure water to cut the workpiece.

For example, the abrasive particles 700*a-c* are loaded into screens 200*a-n* of sieve subassembly 102. The air source is connected to air inlet 206 that connects to pneumatic variable speed motor 108. In one embodiment, air valve 210 is used to control the amount of vibrations to sift the abrasive particles 700*a-c* through the screen and into hopper 104. In this manner, foreign objects 702*a-c* are efficiently removed from abrasive materials. This prevents clogging abrasive feed tube and nozzles during cutting operations.

Though system 100 does not require, in some embodiments a cutting machine 106, such a high-pressure waterjet cutter, can be operatively connected to system 100. In one non-limiting embodiment, cutting machine 106 comprises a cutting head 114, and a particle chamber forming an inlet passageway in fluid communication with the outlet passageway of the hopper 104. Once hopper 104 receives the filtered abrasive particles 700*a-c* filled, pressurized air fills the cavity, forcing abrasive particles 700*a-c* out of hopper 104 through outlet passageway and into a container that feeds the cutting machine 106 high pressure liquid and the filtered abrasive particles 700*a-c* mix to provide the cutting force.

In one non-limiting embodiment, the cutting machine 106 comprises a waterjet cutter having a cutting head 114 capable of delivering, through a specific nozzle, a very thin jet of water, with a diameter between 0.3 mm and 2.0 mm, at very high pressure, up to 6,000 bar and more. The waterjet cutter serves primarily to cut materials, such as metals, stone, marble, glass, plastics, etc. Thus, abrasive particles 700*a-c* are dispersed in the high-pressure water to increase the erosive capacity of the waterjet cutter.

However, it is significant to note that system 100 is operable, not only for waterjet cutting operations/machines, but also sandblasting and other cutting/welding/scraping mechanisms and processes that utilize abrasive particles 700*a-c*, and would benefit from filtering thereof. Thus, cutting machine 106 can include any machine that utilizes abrasive particles 700*a-c* to deform or cut a workpiece.

FIG. 1 illustrates sieve subassembly 102 freely sits on top of hopper 104, and an abrasive feed tube 116 carrying filtered abrasive particles 700*a-c* to the container for pressurized discharge by cutting machine 106. In one non-limiting embodiment, the cutting head of cutting machine 106 comprises a nozzle that discharges a predetermined mixture of a high-pressure liquid and filtered abrasive particles 700*a-c*. Cutting head 114 is operable to discharge a high-pressure liquid for urging the filtered abrasive particles 700*a-c* to cut the workpiece. In some embodiments, system 100 also includes a pressure generator 110 that is configured to forcibly urge the filtered abrasive particles 700*a-c* from the cavity of the hopper 104 to the cutting head 114 where they are mixed with high pressure water.

In operation, sieve subassembly 102 with secured screens sits freely on top of mouth of hopper 104, and the abrasive particles 700*a-c* are uniformly distributed on surface of the selected screen. Next, the pneumatic variable speed motor 108 is powered on. The resultant vibratory motion sifts the abrasive particles 700*a-c* into hopper 104 while removing foreign objects therefrom. This serves to mitigate the risk of waterjet cutting machine 106 down time and loss of parts and material spoilage due to nozzle clogs. In this manner, sieve subassembly 102 enables abrasive particles 700*a-c* to be sifted/sieved directly into hopper 104 while removing foreign objects from the prepackaged abrasive particles 700*a-c* used in the industry. By removing foreign objects and contaminants, the risk of nozzle clogs is virtually eliminated saving downtime and potential of scrapping material/parts being cut.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A system for selectively filtering abrasive particles for a cutting machine, the system comprising:

multiple interchangeable screens, each screen defined by a perimeter region and forming multiple openings defined by a shape and dimension, each opening being defined a unique shape and dimension;

a sieve subassembly comprising a containment ring and a main base;

a two-piece split clamp ring, the two-piece split clamp ring and the main base sandwiching the perimeter region of the screens, whereby multiple screens interchangeably join the sieve subassembly;

a pneumatic variable speed motor operably connected to the main base of the sieve subassembly, the pneumatic variable speed motor being operable to vibrate the screens at variable speeds;

an air inlet in fluid communication with the pneumatic variable speed motor, the air inlet operable to enable discharge of air flow into the pneumatic variable speed motor; and an air valve operatively joined with the air inlet, the air valve configured to regulate the air flow through the air inlet, whereby the air valve regulates the speed and intensity of vibrations to the screens.

2. The system of claim 1, wherein the two-piece split clamp ring is defined by an annular shape.

3. The system of claim 1, wherein the two-piece split clamp ring comprises a steel ring.

4. The system of claim 1, further comprising at least one fastener operable to releasably fasten the screens to the sieve subassembly.

5. The system of claim 1, further comprising a hopper defined by multiple sidewalls forming an outlet passageway, the sidewalls defining a cavity and extending up to a peripheral edge forming a mouth, the peripheral edge of the sidewalls disposed to detachably attach to the sieve subassembly.

6. The system of claim 5, wherein the two-piece split clamp ring rests inside the mouth of the hopper.

7. The system of claim 1, wherein the pneumatic variable speed motor joins with the main base of the sieve subassembly.

8. The system of claim 1, wherein the screens are operable to filter at least one foreign debris from multiple abrasive particles, the screens further being operable to segregate different sizes and dimensions of the abrasive particles.

9. The system of claim 8, wherein the abrasive particles are defined by multiple dimensions and shapes.

10. The system of claim 9, wherein the filtered abrasive particles selectively fall through the openings in the screens.

11. The system of claim 10, further the cutting machine comprising a cutting head, and a container forming an inlet passageway in fluid communication with the outlet passageway of the hopper.

12. The system of claim 11, wherein the cutting machine comprises a waterjet cutting machine.

13. The system of claim 12, wherein the cutting head comprises a nozzle that discharges a predetermined mixture of a high-pressure liquid and the filtered abrasive particles.

14. The system of claim 13, wherein the container is operable to receive the abrasive particles from the hopper and discharge a high-pressure liquid for urging the filtered abrasive particles to the cutting head.

15. The system of claim 14, further comprising a pressure generator operable to forcibly urge the filtered abrasive particles from the cavity of the hopper to the container.

16. A system for selectively filtering abrasive particles for a cutting machine, the system comprising:

multiple interchangeable screens, each screen defined by a perimeter region and forming multiple openings defined by a shape and dimension, each opening being defined a unique shape and dimension, the screens being operable to filter at least one foreign debris from multiple abrasive particles, the screens further being operable to segregate different sizes and dimensions of the abrasive particles;

a sieve subassembly comprising a containment ring and a main base that are welded together;

a two-piece split clamp ring, the two-piece split clamp ring and the main base sandwiching the perimeter region of the screens, whereby multiple screens interchangeably join the sieve subassembly;

a pneumatic variable speed motor operably connected to the sieve subassembly, the pneumatic variable speed motor being operable to vibrate the screens at variable speeds;

an air inlet in fluid communication with the pneumatic variable speed motor, the air inlet operable to enable discharge of air flow into the pneumatic variable speed motor; and an air valve operatively joined with the air inlet, the air valve configured to regulate the air flow through the air inlet, whereby the air valve regulates the speed and intensity of vibrations to the screens.

17. The system of claim 16, wherein the abrasive particles comprise multiple dimensions and shapes, wherein the filtered abrasive particles selectively fall through the openings in the screens, and into the connected hopper.

18. The system of claim 16, further comprising a hopper defined by multiple sidewalls forming a cavity and extending up to a peripheral edge that forms a mouth, the peripheral edge of the sidewalls disposed to join the two-piece split clamp ring of the sieve subassembly.

19. The system of claim 16, further comprising a pressure generator operable to forcibly urge the filtered abrasive particles from the cavity of the hopper to the container.

20. A system for selectively filtering abrasive particles for a cutting machine, the system consisting of:

multiple interchangeable screens, each screen defined by a perimeter region and forming multiple openings defined by a shape and dimension, each opening being defined a unique shape and dimension, the screens being operable to filter at least one foreign debris from multiple abrasive particles, the screens further being operable to segregate different sizes and dimensions of the abrasive particles;

a sieve subassembly comprising a containment ring and a main base that are welded together;

a two-piece split clamp ring, the two-piece split clamp ring and the main base sandwiching the perimeter region of the screens, whereby multiple screens interchangeably join the sieve subassembly;

at least one fastener operable to releasably fasten the screens to the sieve subassembly;

a pneumatic variable speed motor operably connected to the main base of the sieve subassembly, the pneumatic variable speed motor being operable to vibrate the screens at variable speeds;

an air inlet in fluid communication with the pneumatic variable speed motor, the air inlet operable to enable discharge of air flow into the pneumatic variable speed motor; and an air valve operatively joined with the air inlet, the air valve configured to regulate the air flow through the air inlet, whereby the air valve regulates the speed and intensity of vibrations to the screens.

* * * * *